US006062416A

United States Patent [19]

Smillie

[11] Patent Number: 6,062,416

[45] Date of Patent: May 16, 2000

[54] CLOTHES HAMPER

[76] Inventor: Alexandra Martina Smillie, 5829 Main Street, Lockport Manitoba, Canada, R1A 3C4

[21] Appl. No.: 09/037,911

[22] Filed: Mar. 9, 1998

[51] Int. Cl.[7] ..... B65D 1/24

[52] U.S. Cl. ..... 220/524; 220/503; 220/909

[58] Field of Search ..... 220/524, 503, 220/505, 526, 528, 558, 909

[56] References Cited

U.S. PATENT DOCUMENTS

| | | | |
|---|---|---|---|
| D. 142,649 | 10/1945 | Kohen | 220/909 X |
| 642,409 | 1/1900 | Yancey | 220/503 X |
| 1,481,194 | 1/1924 | Fischer | 220/503 |
| 2,625,973 | 1/1953 | Weldon et al. | 220/909 X |
| 2,736,454 | 2/1956 | McConnell | 220/909 X |
| 2,895,782 | 7/1959 | Fragale | 220/909 X |
| 4,893,722 | 1/1990 | Jones | 220/503 |
| 5,074,572 | 12/1991 | Delmerico et al. | 220/909 X |
| 5,662,235 | 9/1997 | Nieto | 220/909 X |

*Primary Examiner*—Steven Pollard
*Attorney, Agent, or Firm*—Adrian D. Battison; Murray E. Thrift

[57] ABSTRACT

A container for sorting and storing items to be laundered is described. The container comprises two lower compartments for storing bulkier items and two inner compartments arranged to pivot within the container from a position wherein the inner compartment(s) are within the container to an outward position wherein the inner compartment(s) are outward of the container. Furthermore, the inner compartments are arranged to accept one or more rigid inserts therein. In operation, items to be laundered together are deposited into the desired rigid insert(s). When laundry day arrives, the rigid insert(s) are removed from the inner compartment(s) of the container and emptied directly into the washing machine. As the items to be laundered have already been sorted, the time and effort required to do the laundry is significantly decreased. Finally, the container, the inner compartments and the rigid inserts all include air holes for improving air circulation throughout the container so that odors and smells do not accumulate.

13 Claims, 3 Drawing Sheets

CLOTHES HAMPER

The present invention relates to a container. More specifically, the present invention relates to a container for individually storing items to be laundered. Even more specifically, the present invention relates to a clothes hamper.

BACKGROUND OF THE INVENTION

One of the more tedious household chores is the sorting and separating of laundry prior to washing. Typically, all of the clothing to be laundered is stored together in a conventional clothes hamper and then sorted immediately prior to washing. Thus, in present conventional hampers the clothing items must all be manually removed, transferred and likely stored in a laundry basket or placed on the floor to sort. This greatly increases the time and effort required to wash the laundry. Clearly, there is a need for a means to sort and store laundry as it becomes soiled.

SUMMARY OF THE INVENTION

It is one object of the invention, therefore, to provide a clothes hamper arranged for sorting and storing items to be laundered.

According to a first aspect of the invention, there is provided a container comprising:

a housing comprising sides, a back, a base and a lid, said lid having an open position and a closed position;

at least one first compartment comprising sides, a back, a front, a base and an open top portion arranged to pivot within the housing, said first compartment having a storage position wherein the first compartment is within the housing and an outward position wherein the first compartment extends outwardly from the housing; and at least one rigid insert arranged to be removably inserted into the first compartment from the open top portion of the first compartment, wherein the rigid insert is removed from the first compartment of the container by pivoting the first compartment to the outward position and removing the rigid insert from the open top portion of the first compartment or by opening the lid of the housing while the first compartment remains in the storage position within the housing and removing the rigid insert from the open top portion of the first compartment. Thus, items to be laundered are stored in the rigid insert until laundry day. At that time, the rigid insert is removed from the first compartment by pivoting the first compartment to the outward position and removing the rigid insert from the open top portion of the first compartment. Alternatively, the insert may be removed from the first compartment of the container by opening the lid of the housing while the first compartment remains in the storage position within the housing. The already sorted items in the rigid insert are then poured directly into the washing machine on laundry day and the rigid insert is then reinserted into the first compartment.

There may be more than one rigid insert within the first compartment and the rigid inserts may be of identical size and/or shape and/or of differing sizes and/or shapes. In some arrangements, for example, narrower inserts may be arranged to store smaller items, such as, for example, socks. Narrower inserts may be arranged to be positioned closest to the side(s) of the housing which may permit the quickest rigid insert removal as the quantities in these inserts may exceed the quantities in the neighboring inserts and may need to be removed more frequently. The container may have more than one first compartment arranged to pivot within the housing. It is of note that the first compartments may be of identical size and/or shape and/or of differing sizes and/or shapes. The multiple first compartments and the multiple rigid inserts allow various items to be laundered to be stored separately, thereby eliminating any need to sort any items immediately prior to washing.

The rigid insert(s) may be perforated for improved air circulation through the rigid insert(s) and the first compartment(s) may be perforated for improved air circulation through the first compartment(s). In addition, at least one of the sides and/or back and/or base and/or lid of the housing may be perforated for improved air circulation through the housing and thus throughout the container, thereby preventing the build-up of smells and odors within the container. The perforations may be arranged such that the perforations in one or both of the sides, and/or in the back, and/or in the front, and/or in the base of the first compartment, the perforations in the rigid insert and the perforations in one or both of the sides, and/or in the back, and/or in the base, and/or in the lid of the housing overlap when the rigid insert(s) are inserted into the first compartment(s) and the first compartment(s) are in the storage position within the housing, thereby improving airflow throughout the container. It is of note that if the perforations were arranged to be positioned in the lid of the housing and/or in the front(s) of the first compartment(s), there may be no overlapping of the perforations.

Furthermore, the container may be arranged to accept and/or include air freshening means, such as, for example, an air freshening device(s) positioned in or on the inner face of the lid of the container.

The container may include at least one second compartment adjacent to the first compartment. The second compartment may include means for concealing the second compartment, such as, for example a door, said door having an open position and a closed position for accessing and concealing the second compartment. The container may include locking means for closing and securing the door on the second compartment. The door may include latching means to interact with the locking means. The second compartment may be arranged to store the bulky clothing items to be laundered. There may be more than one second compartment and the second compartments may be of identical size and/or shape and/or of differing sizes and/or shapes. The second compartment(s) may be perforated for improved air circulation through the second compartment(s).

The container may also include locking means for closing and securing the first compartment(s) in the storage position. The front(s) of the first compartment(s) may each include latching means to interact with the locking means.

The rigid insert(s) may be composed of a plastics material. It is of note that molded plastic may temporarily accommodate a damp article(s) of clothing without harming the inside of the rigid insert(s) and thus without harming the inside of the container, unlike in conventional hampers which are restricted in this regard.

Furthermore, the rigid insert(s) being composed of molded plastics permits quick and inexpensive ease of cleaning with economical household products. Rinsing of the rigid insert(s) aids to freshen them and thus rids the rigid insert(s) and the container of unwanted and unpleasant stale odors. Furthermore, the rinsing prevents the odors from accumulating and then lingering, unlike in present conventional hampers which are restricted in this regard.

It is of note that molded plastics light weight may permit both the easiest maneuverability and transportability of the insert(s).

The rigid insert(s), being removable and transportable, may also be utilized as a laundry facility to aid in transporting the clean clothing items to their desired location(s).

The container may include wheeled means for rolling motion of the container and handles for carrying the container. The wheeled means may be removable castors, thereby allowing for either mobility or a permanent location for the container as desired. The handles may also be used to pull the container on the wheeled means.

The rigid insert may comprise a base, a front, sides, a back and an open top portion.

The rigid insert may further comprise engagement means in order to support the rigid insert within the first compartment. The engagement means may comprise a lip on the open top portion of the rigid insert. This would then hold true for each rigid insert.

According to a second aspect of the invention, there is provided a container comprising:

a housing comprising sides, a back and a base;

at least one first compartment comprising sides, a back, a front, a base and an open top portion arranged to pivot within the housing, said first compartment having a storage position wherein the first compartment is within the housing and an outward position wherein the first compartment extends outwardly from the housing; and at least one rigid insert arranged to be removably inserted into the first compartment from the open top portion of the first compartment, wherein the rigid insert is removed from the first compartment of the container by pivoting the first compartment to the outward position and removing the rigid insert from the open top portion of the first compartment.

According to a third aspect of the invention, there is provided a container comprising:

a housing comprising sides, a base and a lid, said lid having an open position and a closed position;

at least one compartment located within the housing; and at least one rigid insert arranged to be removably inserted into the compartment located within the housing, wherein the rigid insert is removed from the compartment of the container by opening the lid of the housing and removing the rigid insert from the compartment located within the housing.

Thus, the container is used to sort and store laundry as it becomes soiled in the removable rigid inserts. As a further result of this arrangement, rigid inserts from first compartments from multiple containers containing the same type of laundry, such as, for example, socks, may all be removed and all those contents from each rigid insert from each container may then be effortlessly combined into the washing machine and washed. The emptied rigid inserts from the multiple containers are then re-inserted into the first compartments within the containers to be re-loaded. The advantages to these individual and removable and transportable rigid inserts as indicated above is then self-explained in the time saved and the effort reduced either with a single container or multiple containers. At the discretion of the user, once the laundry is completed, it is of note that the emptied rigid insert(s) being removable and transportable may furthermore be utilized as a laundry facility to aid in transporting the clean clothing items back to their desired location(s).

The sides, the base, the back and the front are all connected to each other to form the first compartment unit. As one first compartment is pulled outward, the inner unit consisting of the sides, the base, the back, the front and the rigid insert(s) all come together in a simplified outward motion.

As noted above, in present conventional hampers the clothing must all be manually removed and likely stored in a laundry basket or placed on the floor to sort. However, with the above-described container, there is no further manual removal of the clothing and the need to handle the clothing a second time has also been eliminated.

DETAILED DESCRIPTION

Figure 1:
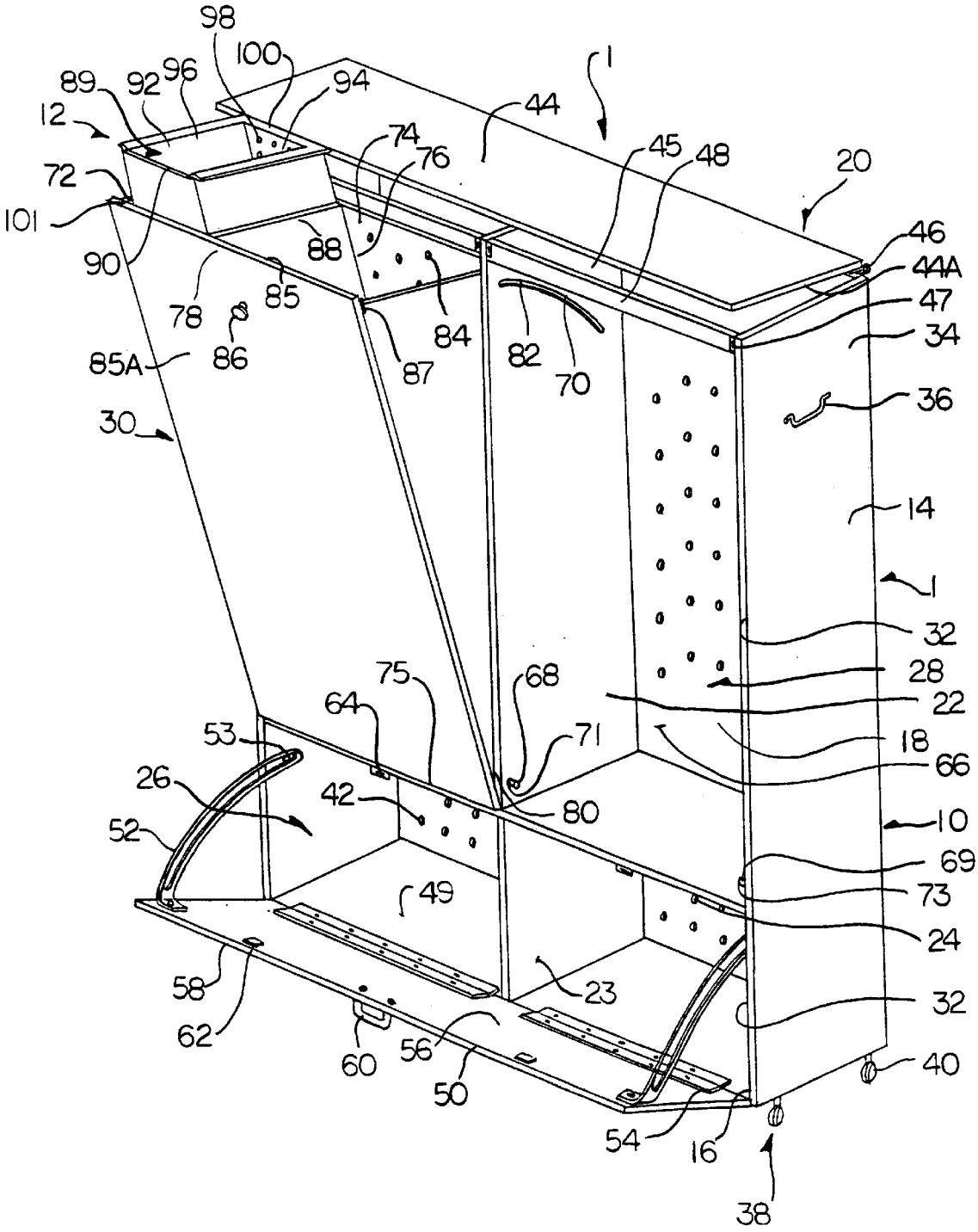
FIG. 1 is an isometric view of the container.

Referring to the drawings, a container 1 comprises a housing 10 and rigid inserts 12.

The housing 10 comprises sides 14, a base 16, a back 18, a rail 48, a top portion 20, an upper vertical panel 22, a lower vertical panel 23, a horizontal panel 24, two lower compartments 26, two upper compartments 28 and two inner compartments 30. Of note is that the housing 10 is arranged such that the top portion 20 and the base 16 form the top and the bottom of the container 1 respectively. Furthermore, the two upper compartments 28 are positioned immediately beneath the top portion 20 and directly above the horizontal panel 24 while the two lower compartments 26 are positioned immediately beneath the horizontal panel 24 and directly above the base 16.

The sides 14 comprise inner faces 32 and outer faces 34. The outer faces 34 include handles 36 located proximal to the top portion 20 of the housing 10 for carrying or assisting in an easier move of the container 1. In this embodiment, the handles 36 comprise detachable drop or chest handles which are designed not to protrude from the container 1 and designed not to require any additional space in order to accommodate what would be a permanent extension as with the usage of alternative handles. However, it is of note that other suitable handles may be used.

The base 16 includes wheeled means 38 for rolling motion of the container 1. In this embodiment, the wheeled means 38 comprise removable castors 40.

The back 18 of the housing 10 includes a plurality of apertures 42 spaced longitudinally and staggered in multiple rows along the back 18 for improving airflow through the container 1 as described below.

The rail 48 extends between the sides 14 of the housing 10 at a position proximal to the top portion 20 of the housing 10. The rail 48 includes locking means 47 for closing the inner compartments 30 as described below. In this embodiment, the locking means 47 comprise magnetic locks.

The top portion 20 of the housing 10 comprises a lid 44 and a hinge 46. The hinge 46 connects the lid 44 to the back 18 of the housing 10 such that the lid 44 has an open position and a closed position. The lid 44 has an inner face **44*a* and the inner face 44*a* of the lid 44 is arranged to rest on the sides 14 of the housing 10 and the upper vertical panel 22. In this embodiment, there is an open area 45 between the inner face 44*a* of the lid 44 and the rail 48 which is intercepted by the upper vertical panel 22. The open areas 45 prevent accidental closing of the lid 44 on one's fingers. The upper vertical panel 22 is notched in order to accommodate the rail 48 in one piece. Of note is that the lid 44 of the top portion 20 of the housing 10 is arranged to be open so that the two upper compartments 28 may be accessed freely from the top portion 20 of the housing 10 when the lid 44** is in the open position.

The horizontal panel 24 extends between the sides 14 of the housing 10, thereby dividing the housing 10 into the upper compartment 28 and the lower compartment 26. The upper vertical panel 22 extends from the horizontal panel 24 to the inner face 44*a* of the lid 44 of the top portion 20 of the housing 10 when the lid 44 is in the closed position, thereby forming the two upper compartments 28. The lower vertical panel 23 extends from the horizontal panel 24 to the base 16 of the housing 10, thereby forming the two lower compartments 26.

The two lower compartments 26 extend from the horizontal panel 24 to the base 16 of the housing 10. Of note is that the two lower compartments 26 are arranged to have an open front face 49 for accessing the two lower compartments 26. In this embodiment, the two lower compartments 26 comprise a door 50, brackets 52, bracket pins 53 and hinges 54. The door 50 is shaped and arranged to fit over the front faces 49 of the two lower compartments 26 and the lower portion of the sides 14 of the housing 10. The door 50 further comprises an inner face 56 and an outer face 58. The hinges 54 connect the inner face 56 of the door 50 to the base 16 of the housing 10. The brackets 52 act as a support to maintain the door 50 in the open position and to connect the inner face 56 of the door 50 to the sides 14 of the housing 10. The brackets 52 engage the bracket pins 53 for a sliding fit thereon such that the door 50 opens outward and away from the base 16 of the housing 10. It is of note that an alternative mechanism may be used. The door 50 is arranged to have a closed position wherein access to the two lower compartments 26 is prevented and an open position wherein the two lower compartments 26 are accessible. The outer face 58 of the door 50 includes a handle or knob 60 for opening and closing the door 50 as described below. The inner face 56 of the door 50 includes latching means 62 arranged to interact with locking means 64 positioned on the horizontal panel 24 when the door 50 is in the closed position for closing the door 50 as described below. In this embodiment, the locking means 64 comprise magnetic locks and the latching means 62 comprise magnetic latches. It is of note that other suitable locking means and/or latching means may be used to close and secure the lower compartment(s) 26 in the closed position.

The two upper compartments 28 extend from the horizontal panel 24 to the inner face 44*a* of the lid 44 of the top portion 20 of the housing 10 when the lid 44 is in the closed position. Of note is that the two upper compartments 28 are arranged to have an open front face 66 for accessing the two upper compartments 28. The two upper compartments 28 are arranged to accept the two inner compartments 30 for pivoting therein. Specifically, the upper compartments 28 include one long pivot pin 68, two shorter pivot pins 69 and arcuate slots 70. The one long pivot pin 68 is inserted through an aperture 71 in the upper vertical panel 22. Specifically, the aperture 71 in the upper vertical panel 22 is sized to be a press fit for the one long pivot pin 68. The shorter pivot pins 69 are inserted into apertures 73 in the inner faces 32 of the sides 14 of the housing 10. Specifically, the shorter pivot pins 69 are inserted into the apertures 73 in the inner faces 32 as a press fit. Furthermore, the aperture 71 in the upper vertical panel 22 and the apertures 73 in the inner faces 32 are located at positions proximal to the horizontal panel 24. The arcuate slots 70 are positioned one on each side of the upper vertical panel 22 below the top portion 20 of the housing 10 for limiting pivoting of the inner compartments 30 as described below. In alternative arrangements, there may be one additional arcuate slot 70 positioned on each inner face 32 of the sides 14 of the housing 10, below the top portion 20 of the housing 10, such that there are two arcuate slots 70 per upper compartment 28 to prevent any imbalance of the two inner compartments 30 when pivoting, or there may be a single arcuate slot 70 extending through the upper vertical panel 22. It is of note that an alternative mechanism may be used.

The two inner compartments 30 are arranged to be fitted into the two upper compartments 28 respectively for pivoting therein as described below. The inner compartment 30 comprises sides 72, a back 74, a base 75, an open top portion 76, a front 78, pivot apertures 80 and a bolt 82. Furthermore, the front 78 of the inner compartment 30 comprises an inner face 85 and an outer face 85*a*. The outer face 85*a* of the front 78 includes a handle or knob 86 for opening and closing the inner compartment 30 as described below. The back 74 of the inner compartment 30 includes a plurality of apertures 84 spaced longitudinally and staggered in multiple rows along the back 74. These apertures 84 are arranged to overlap with the apertures 42 in the back 18 of the housing 10 when the inner compartment 30 is mounted in the housing 10 for improving airflow through the container 1 as described below. The sides 72 of the inner compartment 30 depend downward from the inner face 85 of the front 78 to the back 74 at an angle along the top portion 76 of the inner compartment 30 so that in this embodiment the inner compartment 30 may be pivoted to the outward position without contacting the rail 48. The front 78 of the inner compartment 30 is arranged to be longer and wider than the back 74 of the inner compartment 30 such that the front 78 extends beyond the sides 72 of the inner compartment 30 as described below. The inner face 85 of the front 78 includes latching means 87 located at positions proximal to the top portion 76 of the inner compartment 30 for closing and securing the inner compartment 30 in the storage position as described below. In this embodiment, the latching means 87 comprise magnetic latches. The top portion 76 of the inner compartment 30 is open and arranged to accept the rigid inserts 12 inserted from the top portion 76 of the inner compartment 30 as described below. In this embodiment, the inner compartment 30 includes a divider 88 extending from the inner face 85 of the front 78 of the inner compartment 30 to the back 74 of the inner compartment 30 such that each inner compartment 30 is arranged to accept two rigid inserts 12 therein. Furthermore, the pivot apertures 80 of the inner compartment 30 are located at positions proximal to the inner face 85 of the front 78 on the sides 72 of the inner compartment 30 for inserting the long pivot pin 68 and one shorter pivot pin 69 therein as described below. Furthermore, the pivot apertures 80 of the inner compartments 30 are sized to be a loose fit for the shorter pivot pins 69 and the one long pivot pin 68 in order to enable the inner compartments 30 to pivot freely. The inner compartment 30 is arranged such that the bolt 82 extends from the side 72 adjacent to the arcuate slot 70 positioned on the upper vertical panel 22. The bolt 82 is located at a position proximal to the top portion 76 of the inner compartment 30 for insertion into the arcuate slot 70 as described below. In an alternative arrangement wherein there are two arcuate slots 70 per upper compartment 28, there are two bolts 82 per inner compartment 30. The inner compartment 30 is then arranged such that the additional bolt 82 is positioned on the side 72 of the inner compartment 30 that is non-adjacent to the upper vertical panel 22. The bolt 82 is located at a position proximal to the top portion 76 of the inner compartment 30 for insertion into the arcuate slot 70 positioned on the inner face 32 of the side 14 of the housing 10.

The rigid inserts 12 are arranged to be inserted into the inner compartments 30 as described below. In this embodiment, the rigid insert 12 comprises a base 89, a front 90, sides 92, a back 94 and an open top portion 96. The backs 94 of the rigid inserts 12 include a plurality of apertures 98 arranged to overlap with the apertures 84 in the backs 74 of the inner compartments 30 and the apertures 42 in the back 18 of the housing 10 when the rigid inserts 12 are inserted into the inner compartments 30 and the inner compartments 30 are mounted in the housing 10 for improving airflow through the container 1 as described below. The top portion 96 of the rigid insert 12 is open and includes a lip 100 that extends laterally outward from the sides 92 and the back 94 of the rigid insert 12. Furthermore, the top portion 96 of the rigid insert 12 is sloped from the front 90 to the back 94 so that in this embodiment the top portion 96 of the rigid insert 12 does not contact the rail 48 during pivoting of the inner compartment 30 as described below. Of note is that in this embodiment, the rigid insert 12 is composed of molded plastic, although other suitable materials may be used.

The container 1 is assembled as follows. The two inner compartments 30 are fitted into the two upper compartments 28 respectively such that the inner compartments 30 pivot therein. Specifically, the pivot apertures 80 of the inner compartments 30 are mounted onto the long pivot pin 68 and the shorter pivot pins 69 of the upper compartments 28 and the bolts 82 of the inner compartments 30 are inserted into the arcuate slots 70 of the upper compartments 28. As a result of this arrangement, the inner compartment(s) 30 may be pivoted from a storage position wherein the inner compartments 30 are within the housing 10 to an outward position wherein the inner compartment(s) 30 extend outwardly from the housing 10. Of note is that the pivot apertures 80 of the inner compartments 30 are located at positions proximal to the horizontal panel 24 such that it is primarily the top portion 76 of the inner compartments 30 that pivot outward. Furthermore, the inner compartment 30 is arranged such that the bolt 82 moves along the arcuate slot 70 while the inner compartment 30 is pivoting until it reaches a stop, thereby preventing the inner compartment 30 from pivoting too far outward. As noted above, the outer faces 85*a* of the fronts 78 of the inner compartments 30 each include a handle or knob 86 for pulling the inner compartment(s) 30 to the outward position. It is of note that the front 78 of the inner compartment 30 extends beyond the sides 72 of the inner compartment 30. This holds true for each inner compartment 30. The magnetic latches 87 positioned on the inner faces 85 of the fronts 78 of the inner compartments 30 are arranged to interact with the magnetic locks 47 positioned on the rail 48 when the inner compartments 30 are in the storage position. It is of note that alternative latching means and/or locking means may be used to close and secure the inner compartment(s) 30 in the storage position. As a result of this arrangement, the inner compartments 30 are secured in the storage position. The door 50 of the two lower compartments 26 is closed such that the magnetic latches 62 of the door 50 interact with the magnetic locks 64 of the horizontal panel 24, thereby securely closing the door 50. As noted above, the outer face 58 of the door 50 includes a handle or knob 60 for opening and closing the door 50. Next, the lid 44 of the top portion 20 of the housing 10 which is hinged to the back 18 of the housing 10 is placed in the open position while the inner compartments 30 are in the storage position for insertion of the rigid inserts 12 into the inner compartments 30. Alternatively, the rigid inserts 12 are inserted into the inner compartments 30 by pivoting the inner compartments 30 to the outward position while the lid 44 remains closed. The rigid inserts 12 are then inserted into the inner compartments 30 through the open top portion 76 of the inner compartments 30 such that, for example, in one inner compartment 30, a portion of the lips 100 of the top portion 96 of the rigid inserts 12 rest on the divider 88 of the inner compartment 30, a portion of the lips 100 rest on the back 74 of the inner compartment 30, and a portion of the lip 100 of one rigid insert 12 rests on one side 72 of the inner compartment 30 while a portion of the lip 100 of the other rigid insert 12 rests on the opposite side 72 of the inner compartment 30. Of note is that in this embodiment, the inner compartments 30 are arranged such that each inner compartment 30 holds two rigid inserts 12.

Figure 2:
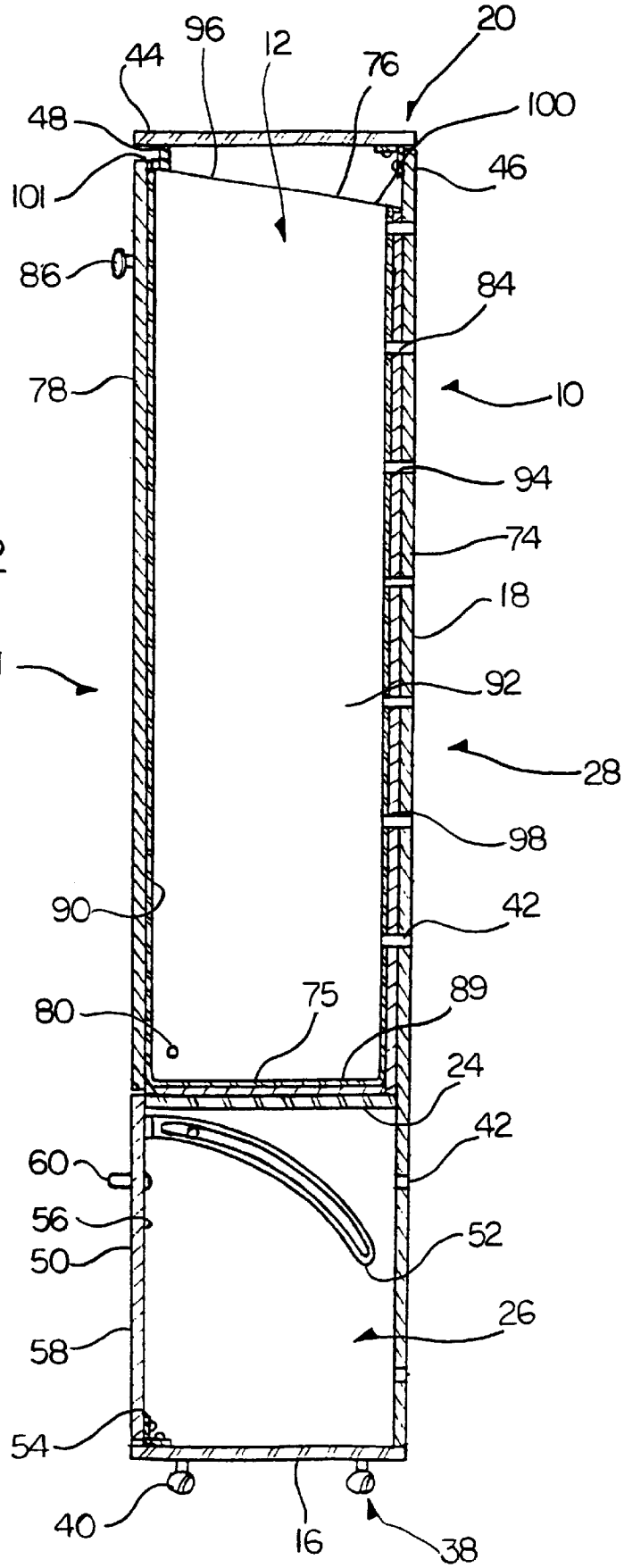
FIG. 2 is a side view in cross-section of the container.
Figure 3:
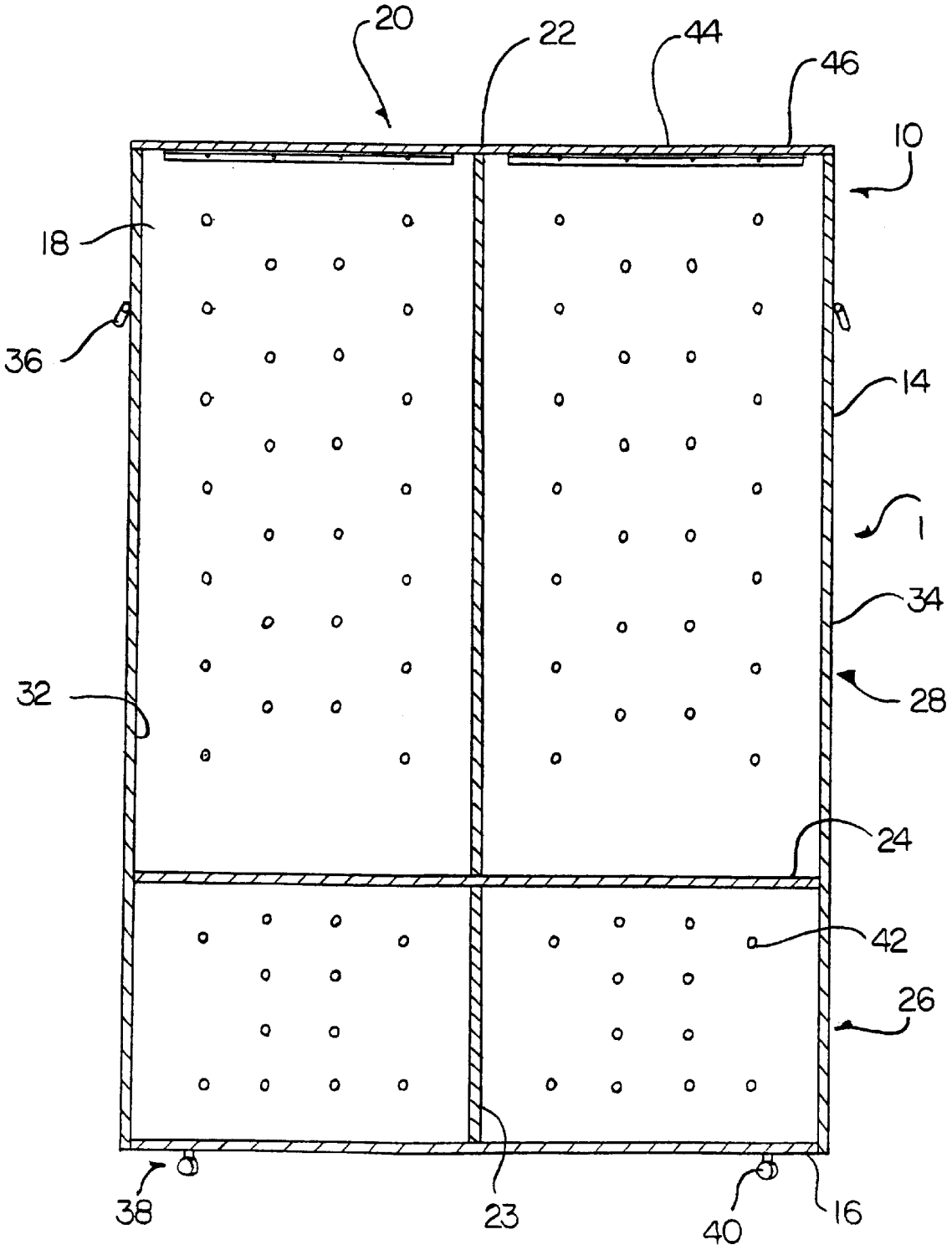
FIG. 3 is a front view in cross-section of the container.

In operation, the lid 44 of the top portion 20 of the housing 10 is moved to the open position and items to be laundered are sorted by depositing the items of a given type into a specific rigid insert 12. Alternatively, items to be laundered may be deposited when the lid 44 is in the closed position by pivoting the inner compartment(s) 30 to the outward position and depositing the items into the rigid insert(s) 12. Thus, the items to be laundered are deposited into the rigid inserts 12 such that each of the rigid inserts 12 may hold a specific type of laundry. As the top portion 96 of the rigid inserts 12 are open and the top portion 76 of the inner compartments 30 are open and the lid 44 of the top portion 20 of the housing 10 is in the open position, items to be laundered may be deposited into the rigid insert(s) 12 while the inner compartments 30 remain in the storage position or alternatively the items to be laundered may be deposited into the rigid insert(s) 12 while the lid 44 is in the closed position and the inner compartment(s) 30 are pivoted to the outward position. Furthermore, the bulky items may be stored for laundering in either or both of the two lower compartments 26 by pulling on the handle or knob 60 of the door 50 of the two lower compartments 26 such that the door 50 is in the open position and then inserting the bulky items into either or both of the two lower compartments 26. The door 50 is then closed such that the magnetic latches 62 of the door 50 interact with the magnetic locks 64 of the horizontal panel 24, thereby securely closing the door 50 of the two lower compartments 26. As noted above, the apertures 42 of the housing 10 are aligned with the apertures 84 of the inner compartments 30 and the apertures 98 of the rigid inserts 12 when the rigid inserts 12 are inserted into the inner compartments 30 and the inner compartments 30 are in the storage position within the housing 10 as shown in FIG. 2. Furthermore, the apertures 42 along the back 18 of the housing 10 extend to the two lower compartments 26 as shown in FIG. 3. As a result of this arrangement, airflow throughout the rigid inserts 12 as well as the two inner compartments 30, the two upper compartments 28 and the two lower compartments 26 of the container 1 is promoted, meaning that odors and smells will not gather within the container 1.

All the items to be laundered may be transported to the laundry room by pulling the container 1 by the handle 36 or by pushing the container 1 such that the container 1 rolls on the wheeled means 38 into the laundry room or the container 1 may be transported by carrying the container 1 by the handles 36 on the sides 14 of the housing 10. Once the container 1 is in the laundry room, at the discretion of the user, the lid 44 is placed in the open position and/or the inner compartment(s) 30 are pivoted to the outward position for removal of the rigid insert(s) 12 as described above. As noted above, the sides 72 of the inner compartment 30 depend downward from the inner face 85 of the front 78 of the inner compartment 30 to the back 74 of the inner compartment 30 at an angle along the top portion 76 so that the inner compartment 30 may be pivoted to the outward position without contacting the rail 48. This again holds true for each inner compartment 30. Similarly, the top portion 96 of the rigid inserts 12 are sloped from the front 90 to the back 94 so that the top portion 96 of the rigid inserts 12 do not contact the rail 48 during pivoting of the inner compartments 30 to the outward position. From there, the desired rigid insert(s) 12 are removed from the inner compartment(s) 30 by grasping the lip(s) 100 of the rigid insert(s) 12 and pulling the rigid insert(s) 12 upward through the open top portion 76 of the inner compartment(s) 30. As noted previous, the rigid insert(s) 12 may be removed by opening the lid 44 or by pivoting the inner compartment(s) 30 to the outward position. The desired rigid insert(s) 12 containing the presorted items are removed from the inner compartment(s) 30 of the container 1 and the contents of the rigid insert(s) 12 are then poured directly into a washing machine by tipping the rigid insert(s) 12 towards the washing machine and allowing the items to fall into the washing machine. The rigid insert(s) 12 are reinserted into the inner compartment(s) 30 in preparation to be re-loaded. In addition, the items in one or both of the two lower compartments 26 may be removed and placed into the washing machine, although, depending on what is being washed, this is not necessarily done at the same time as the rigid insert(s) 12 are emptied into the washing machine. Once all of the laundry is done, the container 1 is rolled or carried out of the laundry room and returned to its previous location. Alternatively, the container 1 may remain in one location and the rigid insert(s) 12 may be carried individually to the laundry room. In this arrangement, the removable castors 40 may be removed such that the container 1 will not roll.

Thus, the container 1 may be used to sort items to be laundered as the individual items become soiled by storing items to be washed together in a specific rigid insert 12. It is of note that in this embodiment, the rigid inserts 12 are composed of molded plastic and, as a result of this arrangement, should the need arise, the rigid inserts 12 have the capability of accommodating a temporary placement of a dampened article(s) of clothing with no harm done to the inside of the rigid insert(s) 12, and thus the container 1. The items are sorted as they are deposited into the different rigid inserts 12. This pre-sorting significantly decreases the time and effort required to do the laundry. As a further result of this arrangement, the need to manually handle each of the items and the need to remove all of the items once they have been placed in the rigid inserts 12 has been eliminated. The removable rigid insert(s) 12 are simply removed from the inner compartment(s) 30 of the container 1 and then transported to the desired location and unloaded with ease as described above. Furthermore, the rigid inserts 12, being removable and transportable, may also be utilized as a laundry facility to aid in transporting the clean clothing items back to their desired location(s). Furthermore, the container 1 is well aerated so that smells and odors will not accumulate within the container 1.

Items to be laundered may be removed from the container 1 by removing the rigid insert(s) 12 from the inner compartment(s) 30 when the lid 44 is in the closed position and the inner compartment(s) 30 are pivoted to the outward position or when the lid 44 is in the open position and the inner compartments 30 are in the storage position. Similarly, items to be laundered may be deposited into the rigid insert(s) 12 within the inner compartment(s) 30 of the container 1 by opening the lid 44 or by pivoting the inner compartment(s) 30 to the outward position while the lid 44 remains closed. As a result of this arrangement, the lid 44 may remain closed without interfering with the depositing and/or removal of items to be laundered from the container 1. Thus, the lid 44 of the container 1 may then alternatively be used as a television stand, a ledge, a shelf or other similar support structure.

The dimensions of the various components of the container 1 may be varied as desired.

In an alternative arrangement, the back 18 of the housing 10 may be comprised of more than one piece, and/or each side 14 of the housing 10 may be comprised of more than one piece.

The overlapping apertures 42 in the back(s) 18 of the housing 10, the apertures 84 in the back(s) 74 of the inner compartment(s) 30 and the apertures 98 in the back(s) 94 of the rigid insert(s) 12 may be arranged in alternative configurations. In an alternative arrangement, the apertures 98 of the rigid insert(s) 12, the apertures 84 of the inner compartment(s) 30 and the apertures 42 of the housing 10 may be arranged to be positioned in an alternative location, such as, for example, in the base of each of these components.

In an alternative arrangement, the rigid insert(s) 12 may not comprise apertures, or the apertures may be located proximal to the open top portion 96 of the rigid insert(s) 12, positioned on the back 94 and/or front 90 and/or side(s) 92 of the rigid insert(s) 12. As a result of either arrangement, the rigid insert(s) 12 may be utilized as a laundry facility to pre-soak a desired clothing item(s).

The container 1 may be arranged to accept and/or include air freshening means, such as, for example, an air freshening device(s) inserted into or positioned onto the inner face 44*a* of the lid 44 of the top portion 20 of the housing 10. The air freshening means may then be put to use at the discretion of the user to furthermore rid the container 1 of unwanted smells and odors and as a further result of this arrangement, the container 1 may possess a pleasant fragrance at all times.

Furthermore, the rigid inserts 12, being composed of molded plastics material, permits a quick and inexpensive ease of cleaning with economical household products. This rinsing aids to freshen the insert(s) 12 and thus rids the insert(s) 12 and the container 1 of unwanted stale odors from accumulating and then lingering.

In alternative embodiments, one or two of the lower compartments 26 may be omitted to lengthen one or two of the upper compartments 28 (and therefore one or two of the inner compartments 30) or to shorten the overall height of the container 1.

Alternatively, the container 1 may be arranged such that the pivoting inner compartment(s) 30 are beneath or beside the non-pivoting lower compartment(s) 26. Alternatively, the container 1 may be arranged such that the non-pivoting lower compartment(s) 26 pivot.

Alternatively, the container 1 may be arranged such that there is one inner compartment 30 mounted in one upper compartment 28.

Of note is that in an alternative arrangement, there may be no open area(s) 45 between the lid 44 and the rail 48.

Of note is that in an alternative arrangement, the upper vertical panel 22 extends from the horizontal panel 24 upwards although not to the inner face 44*a* of the lid 44 of the top portion 20 of the housing 10.

Alternatively, the lid 44 of the top portion 20 of the housing 10 may be omitted from the container 1, and/or for extreme economic purposes, the inner compartment(s) 30 may be arranged not to pivot. In an embodiment of this nature, the inner compartment(s) 30 may be arranged in an alternative configuration and the rigid insert(s) 12 may be arranged in an alternative configuration(s), such as, for example, the individual and removable and transportable rigid insert(s) 12 may be arranged not to slope.

In an alternative embodiment, the lid 44 of the top portion 20 of the housing 10 may be arranged not to open.

In an alternative embodiment, the lid 44 of the top portion 20 of the housing 10 may comprise two hinges rather than a single hinge 46.

In an alternative embodiment, the lower compartment 26 may comprise a single hinge rather than two hinges 54.

Alternatively, the inner compartment 30 may be arranged to accept only one rigid insert 12 or possibly a plurality of rigid inserts 12. Similarly, one of the inner compartments 30 may contain one rigid insert 12 and the other inner compartment 30 may contain more than one rigid insert 12. The rigid inserts 12 inserted therein may be of identical size and/or shape and/or may be of differing sizes and/or shapes.

In an alternative arrangement, the rigid insert(s) 12 may comprise additional means or alternate means for the removal of the rigid insert(s) 12 from within the inner compartment(s) 30 of the container 1, such as, for example, a detachable drop or chest handle(s) positioned on the inside of each rigid insert 12.

In an alternative embodiment designed primarily for children, the container 1 may be equipped with an audio device arranged to emit an audible signal such as music and/or vocal sounds when the lid 44 is opened and/or the inner compartment(s) 30 are pivoted outward for encouraging youngsters to use the container 1.

A mesh netting may be included in the container 1 for the purpose of storing delicates to be laundered.

Alternatively, the door 50 of the lower compartment(s) 26 may be arranged as a sliding door or the container 1 may be arranged such that one door closes and secures and conceals each lower compartment 26. In other embodiments, the container 1 may be arranged such that there is no door securing the lower compartment(s) 26 or the lower compartment(s) 26 may comprise a pull-out drawer(s).

The components of the container 1 may be composed of a variety of materials, such as, for example, sheet metal, particle board with a vinyl exterior, particle board with a fabric exterior, molded plastic exterior for youngsters, particleboard with a melamine finish, particleboard with oak laminates or other color laminates, and/or pine, oak or cherry wood. Furthermore, the container 1 may be treated with varathane or an alternative as protection against the elements. The container 1 may also be treated with a heat and moisture resistant finish. For example, in an embodiment designed for the bathroom, a heat and moisture resistant finish can be added to tolerate excessive moisture levels found in bathrooms.

It is of note that the container 1 in alternative embodiments would be designed for optimum efficiency depending on application. For example, a container 1 designed for use in a bathroom may be arranged in an alternative configuration than that of an all-purpose container 1. For example, in a bathroom container 1, there may be one inner compartment 30 with one or two rigid inserts 12 while in an all-purpose container 1 there may be two inner compartments 30 with two rigid inserts 12 per inner compartment 30.

In an alternative embodiment, the lower compartment(s) 26 may comprise removable means for storage of the clothing items, such as, for example, an insert(s) similar of nature to that of the rigid insert(s) 12 of the inner compartment(s) 30.

The container 1 may be encased in a means of enclosure for advanced cosmetic purpose.

It is of note that the container 1 may be arranged to include any or all combination(s) of the numerous components and/or features described above as desired.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A laundry hamper comprising:

a generally rectangular main housing comprising two parallel sides defining an open top and a lid, said lid being pivotally mounted for movement relative to the sides between an open position exposing the open top and a closed position covering the open top;

at least one generally rectangular compartment member comprising two parallel sides and a front wall at right angles to the sides, the sides and the front wall defining an open top, the compartment member being mounted in the main housing between the sides of the housing with the sides of the compartment member parallel to the sides of the housing and arranged to pivot relative to the housing about an axis at right angles to the sides between a storage position in which the first compartment member is within the housing with the open top of the compartment member at the open top of the housing and an outward position wherein the compartment member is inclined outwardly and forwardly from the housing; and at least one generally rectangular rigid insert having four upstanding side walls, a base and an open top, the insert being arranged to be inserted into the compartment member from the open top of the first compartment member and retained within the compartment member with the open top of the insert at the open top of the compartment member;

the insert and the compartment member being arranged relative to the housing such that, in the storage position of the compartment member, the open top of the insert is at the open top of the housing so that movement of the lid to the open position thereof allows the feeding of materials through the open top of the housing into the open top of the insert for storage therein;

the insert and the compartment member being arranged relative to the housing such that, in the outward position of the compartment member the open top of the insert and the open top of the compartment member are presented forwardly of the sides of the housing for removal of the insert from the compartment member by sliding through the open top of the compartment.

2. The container according to claim 1 wherein there is more than one rigid insert within the compartment member arranged side by side.

3. The container according to claim 1 wherein there is a second compartment member alongside said compartment member also arranged to pivot within the housing and also including at least one removable insert therein.

4. The container according to claim 1 wherein the sides of the housing define a compartment separate from and alongside the compartment member which compartment includes a door having an open position and a closed position.

5. The container according to claim 4 wherein there are locking means for securing the door on the compartment.

6. The container according to claim 1 wherein the compartment member includes latching means for closing and securing the compartment member in the storage position.

7. The container according to claim 1 wherein the housing includes wheels for movement thereof.

8. The container according to claim 7 wherein the wheels comprise removable castors.

9. The container according to claim 1 wherein the housing includes handles.

10. The container according to claim 1 including air freshening means for assisting in the elimination of odors.

11. The container according to claim 1 wherein the insert is supported in the compartment member by a lip arranged around the open top of the insert.

12. A laundry hamper comprising:

a generally rectangular main housing comprising two parallel sides and a rear wall defining an open top and a lid, said lid being pivotally mounted for movement relative to the sides between an open position exposing the open top and a closed position covering the open top;

at least one generally rectangular compartment member comprising two parallel sides, a rear wall and a front wall parallel to the rear wall and at right angles to the sides, the sides, the rear wall and the front wall defining an open top, the compartment member being mounted in the main housing between the sides of the housing with the sides of the compartment member parallel to the sides of the housing and arranged to pivot relative to the housing about an axis at right angles to the sides between a storage position in which the first compartment member is within the housing with the open top of the compartment member at the open top of the housing and an outward position wherein the compartment member is inclined outwardly and forwardly from the housing; and at least one generally rectangular rigid insert having four upstanding side walls including a front and a rear wall parallel to the front wall and two parallel side walls at right angles to the front and rear walls, a base and an open top, the insert being arranged to be inserted into the compartment member from the open top of the first compartment member and retained within the compartment member with the open top of the insert at the open top of the compartment member;

the insert and the compartment member being arranged relative to the housing such that, in the storage position of the compartment member, the open top of the insert is at the open top of the housing so that movement of the lid to the open position thereof allows the feeding of materials through the open top of the housing into the open top of the insert for storage therein;

the insert and the compartment member being arranged relative to the housing such that, in the outward position of the compartment member the open top of the insert and the open top of the compartment member are exposed forwardly of the housing for removal of the insert from the compartment member by sliding through the open top of the compartment;

the insert and the compartment member being arranged relative to the housing such that, in the storage position of the compartment member, the rear wall of the insert lies adjacent and parallel to the rear wall of the compartment member which is adjacent and parallel to the rear wall of the housing, each of the rear walls having apertures therein for allowing passage of air, the apertures in the rear wall of the insert overlapping the apertures in the rear wall of the compartment member which overlap the apertures in the rear wall of the housing.

13. The container according to claim 12 wherein the inserts are of identical size and shape.

* * * * *